US010726802B2

(12) United States Patent
Tomizawa

(10) Patent No.: US 10,726,802 B2
(45) Date of Patent: Jul. 28, 2020

(54) DISPLAY DEVICE AND DISPLAY METHOD

(71) Applicant: Japan Display Inc., Tokyo (JP)

(72) Inventor: Kazunari Tomizawa, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 16/355,020

(22) Filed: Mar. 15, 2019

(65) Prior Publication Data

US 2019/0287471 A1 Sep. 19, 2019

(30) Foreign Application Priority Data

Mar. 16, 2018 (JP) ..... 2018-050128

(51) Int. Cl.
*G09G 3/36* (2006.01)
*G09G 3/34* (2006.01)

(52) U.S. Cl.
CPC ..... *G09G 3/3607* (2013.01); *G09G 3/3413* (2013.01); *G09G 2300/0452* (2013.01); *G09G 2320/0666* (2013.01); *G09G 2340/0457* (2013.01)

(58) Field of Classification Search
CPC ..... G09G 3/3413; G09G 3/3607; G09G 2300/0452; G09G 2320/0666; G09G 2340/0457
See application file for complete search history.

(56) References Cited

U.S. PATENT DOCUMENTS

2008/0062386 A1* 3/2008 Ito ..... G03B 21/006 353/31
2018/0033382 A1 2/2018 Tomizawa

FOREIGN PATENT DOCUMENTS

JP 2008046766 A 2/2008
JP 2018021963 A 2/2018

* cited by examiner

*Primary Examiner* — Stacy Khoo
(74) *Attorney, Agent, or Firm* — K&L Gates LLP

(57) ABSTRACT

According to one embodiment, a display device includes a display panel and a conversion circuit. The display panel is with a first pixel including subpixels of red, first green which is tinged red as compared to a reference green, and blue, and a second pixel including subpixels of red, second green which is tinged blue as compared to the reference green, and blue, where the first pixel and the second pixel are arranged alternately. The conversion circuit is configured to generate a four primary color image of red, first green, second green, and blue from a three primary color image of red, reference green, and blue and to perform rendering the first image and the second image from the four primary color image.

6 Claims, 16 Drawing Sheets

DISPLAY DEVICE AND DISPLAY METHOD

CROSS-REFERENCE TO RELATED APPLICATIONS

This application is based upon and claims the benefit of priority from Japanese Patent Application No. 2018-050128, filed Mar. 16, 2018, the entire contents of which are incorporated herein by reference.

FIELD

Embodiments described herein relate generally to a display device in which subpixels of multiple primary colors are arranged and a display method of the same.

BACKGROUND

In conventional display devices, one pixel includes three primary color subpixels representing red, green, and blue, and color display is achieved by controlling the brightness of each subpixel. However, a range of color reproduction is limited in the display with subpixels of three primary colors. Thus, proposed is a display device with more green primary colors in which four primary color subpixels of R, G1, B, R, G2, and B are arranged in the horizontal direction.

However, in the above arrangement of four primary color subpixels, two subpixels of G1 and G2 are used at the same time when white is displayed, and thus, the resolution is lost to a certain extent.

SUMMARY

The present application relates generally to a display device in which subpixels of multiple primary colors are arranged and a display method of the same.

According to one embodiment, a display device includes a display panel and a conversion circuit. The display panel is with a first pixel including subpixels of red, first green which is tinged red as compared to a reference green, and blue, and a second pixel including subpixels of red, second green which is tinged blue as compared to the reference green, and blue, where the first pixel and the second pixel are arranged alternately. The conversion circuit is configured to generate a four primary color image of red, first green, second green, and blue from a three primary color image of red, reference green, and blue and to perform rendering the first image and the second image from the four primary color image.

DETAILED DESCRIPTION

In general, according to one embodiment, a display device includes a display panel and a conversion circuit. The display panel is with a first pixel including subpixels of red, first green which is tinged red as compared to a reference green, and blue, and a second pixel including subpixels of red, second green which is tinged blue as compared to the reference green, and blue, where the first pixel and the second pixel are arranged alternately. The conversion circuit is configured to generate a four primary color image of red, first green, second green, and blue from a three primary color image of red, reference green, and blue and to perform rendering the first image and the second image from the four primary color image. The conversion circuit prioritizes turning on of the first green in the first pixel and turning on of the second green in the second pixel and adjusts a color temperature of white with red and blue during white displaying of a pixel.

With the above structure, vertical, horizontal, and diagonal lines of single-color are displayed as a straight line, and thus, the range of color reproduction is increased, and the resolution can be increased as well.

Various embodiments will be described hereinafter with reference to the accompanying drawings.

Note that, the disclosure is an example, and the contents of the following description do not limit the scope of the invention. Variations which will easily be conceivable by a person having ordinary skill in the art are naturally encompassed within the scope of the invention. In the figures, dimensions of components may be depicted schematically as compared to actual models of the invention for easier understanding. Elements corresponding to each other between different figures will be referred to by the same reference number, and explanation considered redundant may be omitted.

The display device of the present embodiment will be explained using a liquid crystal display device as an example.

Figure 1:
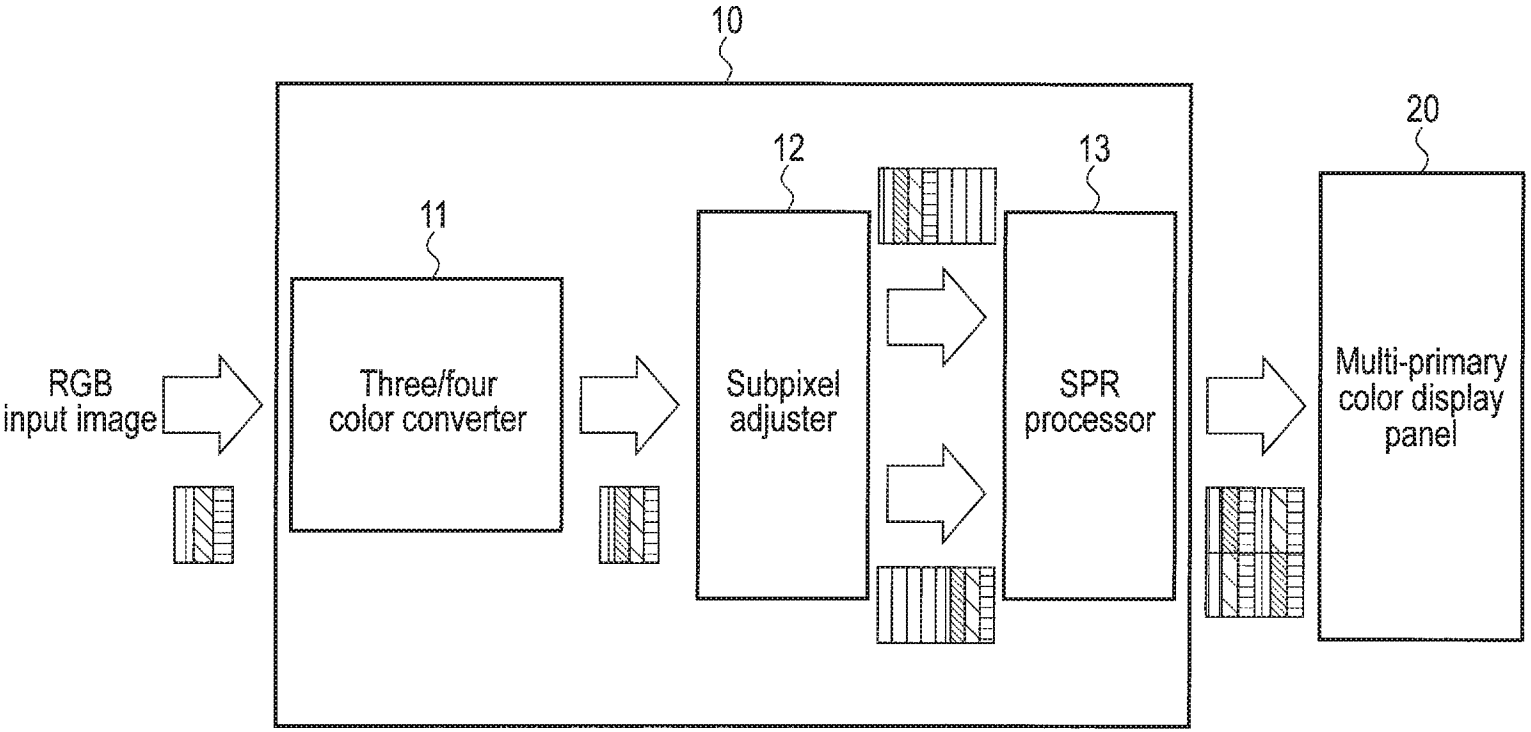
FIG. 1 is a block diagram of the basic structure of a liquid crystal display device of an embodiment.

FIG. 1 is a block diagram of the basic structure of the liquid crystal display device of the present embodiment. The liquid crystal display device includes a signal conversion circuit 10 and a multi-primary color display panel 20.

Figure 2A:
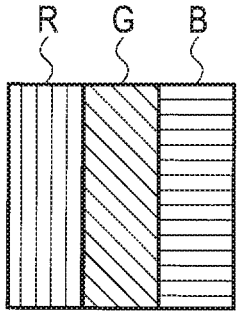
FIGS. 2A to 2F each show a subpixel arrangement of the embodiment.
Figure 2B:
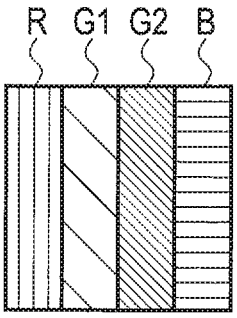
Figure 2C:
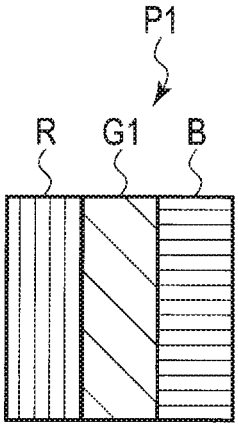
Figure 2D:
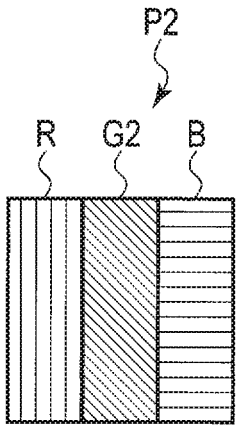
Figure 3:
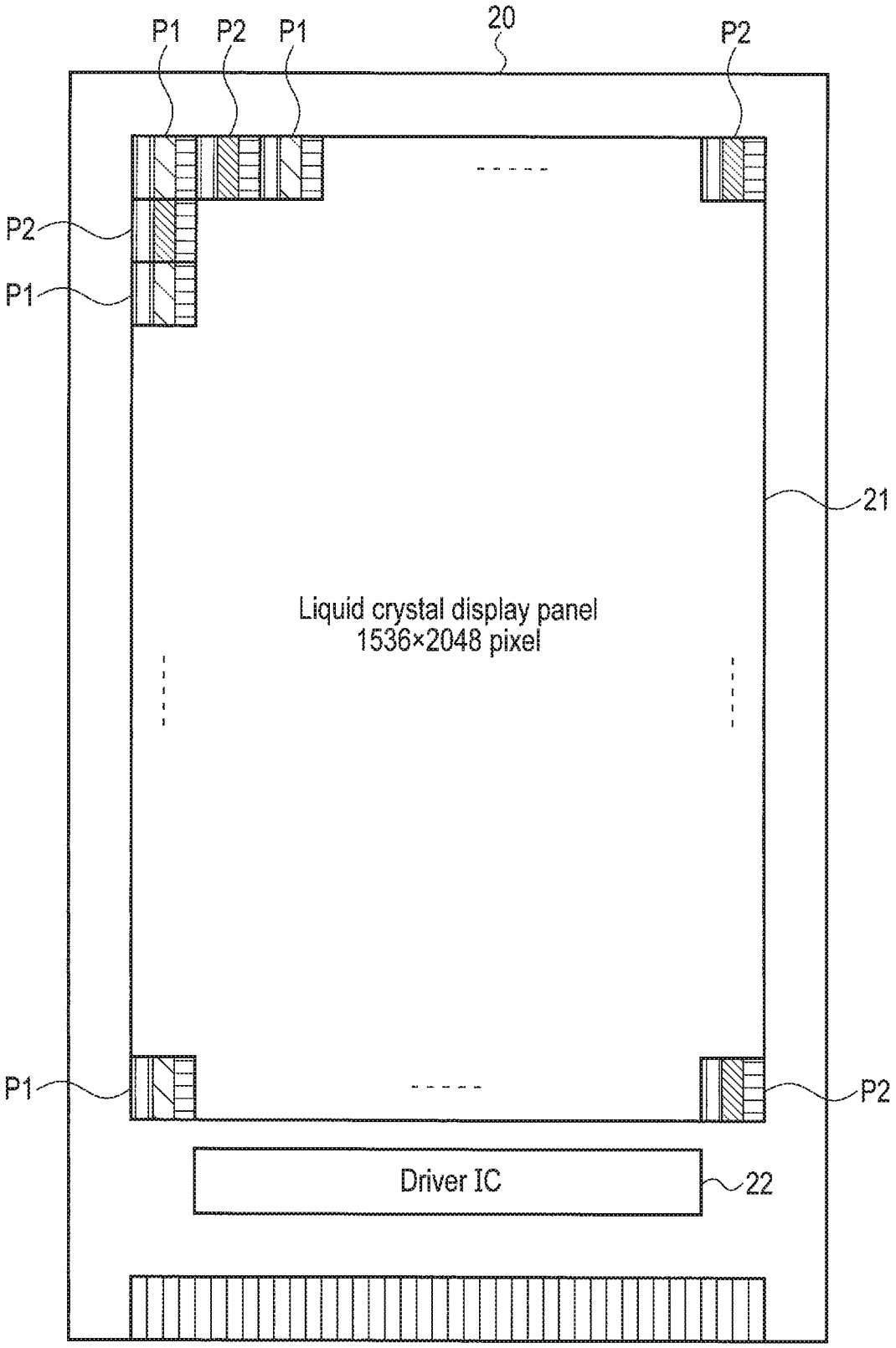
FIG. 3 shows a concept of the structure of a display panel of the embodiment.

The signal conversion circuit 10 includes, as shown in FIG. 1, a three/four color converter 11, subpixel adjuster 12, and subpixel rendering (SPR) processor 13. The three/four color converter 11 converts an input image of three primary colors of red (R), green (G), and blue (B) (cf. FIG. 2A) into image signals corresponding to four primary colors red (R), first green which is tinged red (G1), second green which is tinged blue (G2), and blue (B) (cf. FIG. 2B, hereinafter, will be referred to as 4CF). The subpixel adjuster 12 generates a first image to form a first pixel P1 of three primary colors of R, G1, and B (cf. FIG. 2C) on the basis of the 4CF image signals and a second image to form a second pixel P2 of three primary colors of R, G2, and B (cf. FIG. 2D) on the basis of the 4CF image signals. The SPR processor 13 performs rendering the each subpixel from the first and second images aligning with the subpixel arrangement of the multi-primary color display panel 20. The multi-primary color display panel 20 includes, as shown in FIG. 3, a liquid crystal display panel 21 and a driver IC 22 on a substrate, and therein, 1536×2048 pixels are arranged in the liquid crystal display panel 21, for example.

Figure 2E:
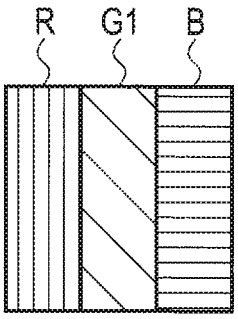
Figure 2F:
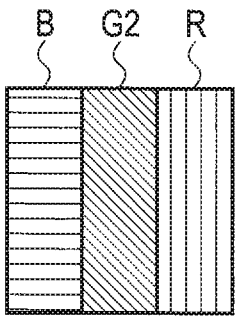

Now, in the pixel structure of the display panel 21 (subpixel arrangement), the first pixel P1 includes subpixels of R, G1, and B, and the second pixel P2 includes subpixels of R, G2, and B, and the first pixels P1 and the second pixels P2 are arranged alternately in the horizontal and vertical directions. The SPR processor 13 performs rendering of the image signals to conform to the pixel structure. Note that, in the following description, the color control of the pixels P1 and P2 arranged in the horizontal direction will be explained while the same applies to the color control of the pixels P1 and P2 arranged in the vertical direction. Furthermore, in the pixel structures shown in FIGS. 2C and 2D, Rs and Bs of the first pixel P1 and the second pixel P2 are arranged the same; however, the same color control can be performed even if Rs and Bs of the first pixel P1 and the second pixel P2 may be switched as shown in FIGS. 2E and 2F.

Figure 4A:
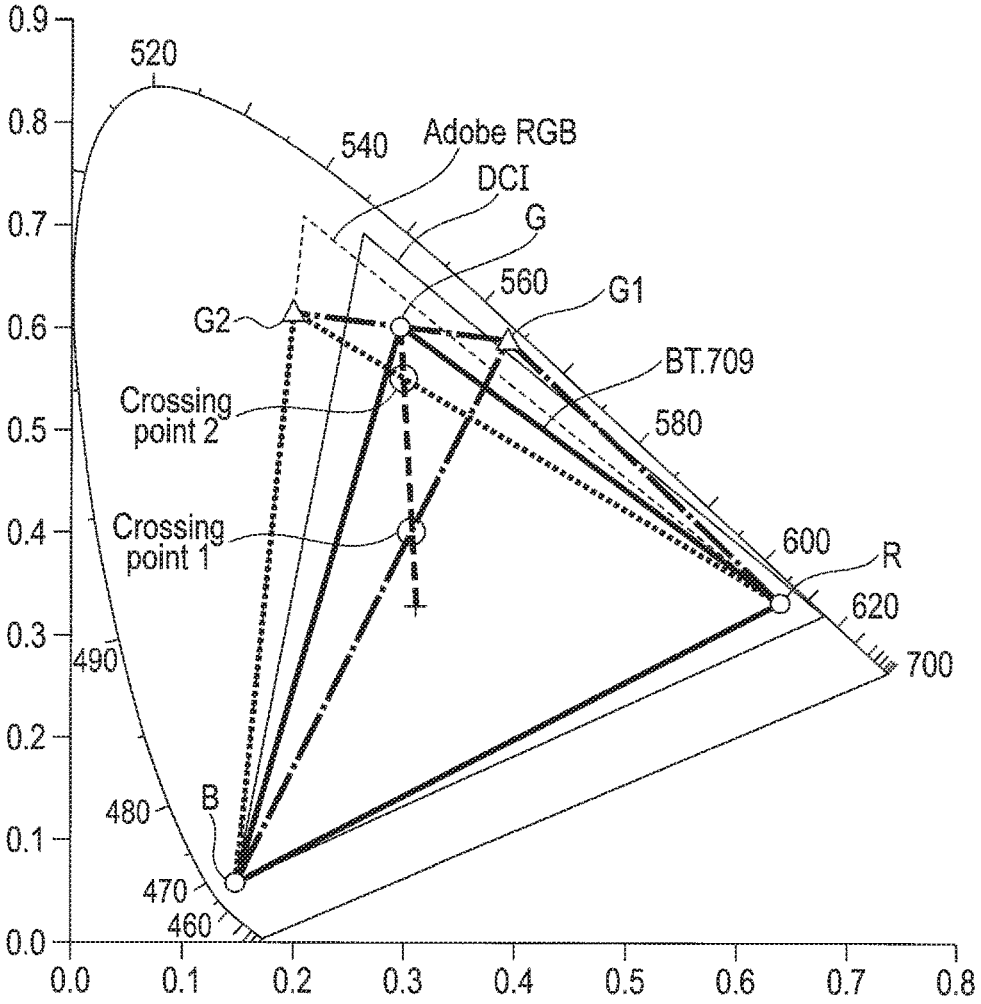
FIGS. 4A to 4C each show example of the gamut distribution of input image and output image of the embodiment.
Figure 4B:
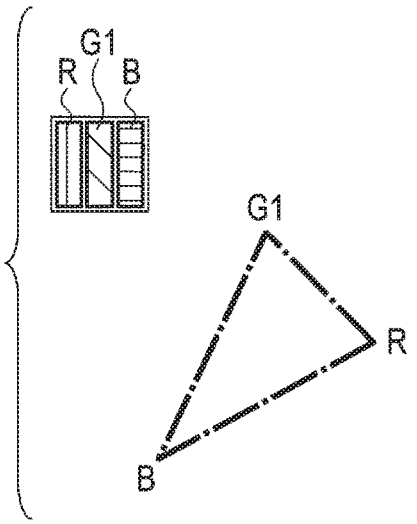
Figure 4C:
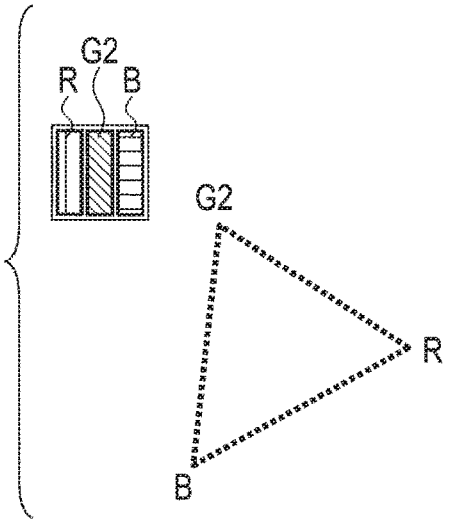

FIG. 4A shows a gamut distribution of input image signals (HDTV broadcast standard BT.709) of the above three primary colors (RGB) (hereinafter referred to as reference gamut distribution), and FIGS. 4B and 4C shows the gamut distribution of the first pixel P1 and the gamut distribution of the second pixel P2, respectively. Coordinate points (x, y) of each gamut distribution share R and B and coordinate points of pixel G of the three primary color image signal are positioned in a position splitting the straight line connecting G1 of the first pixel P1 and G2 of the second pixel P2 in half. Specifically, the coordinate points of R, G1, G2, and B in the gamut distributions are as follows.

R: x=0.640, y=0.330

G: x=0.300, y=0.600

G1: x=0.394, y=0.587

G2: x=0.202, y=0.614

B: x=0.150, y=0.060

The first pixel P1 and the second pixel P2 each can independently represent color within the gamut.

In the present embodiment, the subpixel adjuster 12 prioritizes turning on of G1 or G2 and adjusts the color temperature of white with R and B in the white display of one pixel. Furthermore, in the reference gamut distribution of FIG. 4A, when a crossing point 1 of a reference line connecting the white point W and the green point G and a line connecting G1 and B (one side of P1 in the gamut distribution) and a crossing point 2 of the reference line and a line connecting G2 and B (one side of P2 of the gamut distribution) are imagined, the adjustment of the color temperature is performed to the crossing point 1 or the crossing point 2 without changing the brightness of G1 and G2. In that case, vertical, horizontal, and diagonal lines of single color can be displayed in RGBW, and the resolution can be maintained.

Hereinafter, a specific example will be explained.

(1) Method of Displaying White

Figure 5A:
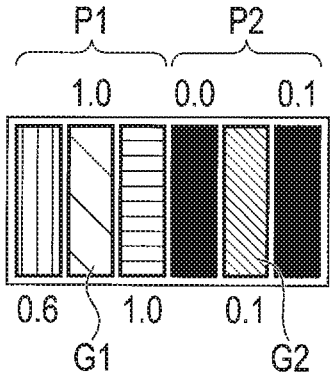
FIGS. 5A to 5C show a ratio of the brightness of subpixels of first and second pixels when white is achieved in the embodiment.
Figure 5B:
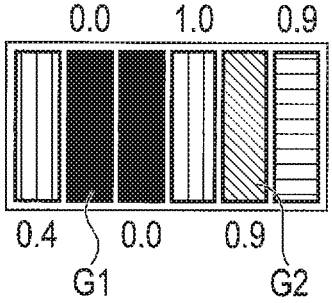
Figure 5C:
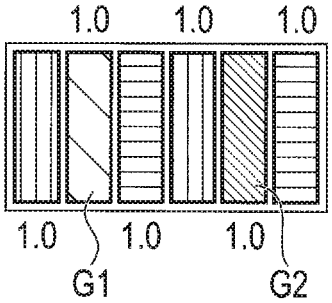

In the adjustment of subpixels, white can be represented by a combination of R, G1, and B, or a combination of R, G2, and B. FIG. 5A shows a brightness ratio between P1 (R, G1, and B) and P2 (R, G2, and B) in a case where the left side (pixel 1) is mainly lit, and FIG. 5B shows the brightness ratio in a case where the right side (pixel 2) is mainly lit. Note that, as shown in FIG. 5C, when both the pixels 1 and 2 are lit, all the subpixels are lit.

(2) SPR Process

Figure 6:
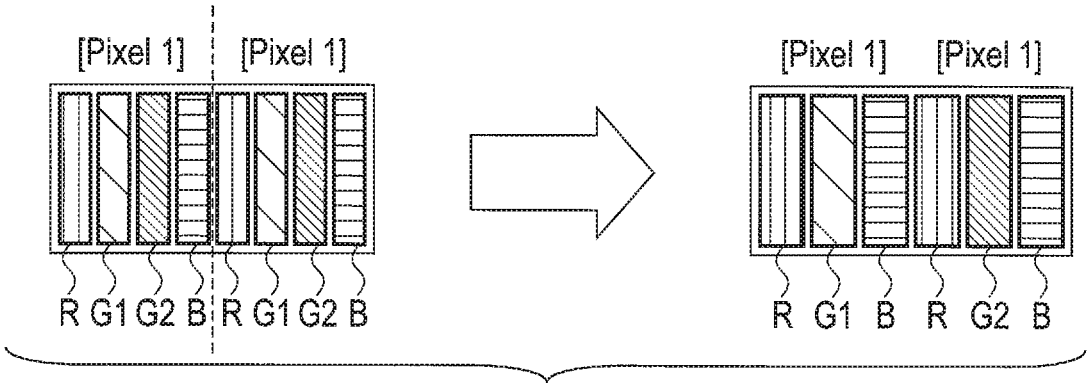
FIG. 6 shows a concept of a SPR process of the embodiment in which 4CF pixels 1 and 2 arranged side-by-side are converted into pixels of subpixel arrangement of P1 and P2.

The 4CF (R, G1, G2, and B) image adjusted by the subpixel adjuster 12 is converted into an image with subpixel arrangement of P1 (R, G1, and B) and P2 (R, G2, and B) by the SPR processor 13. In this example, pixels 1 and 2 of 4CF arranged side-by-side are converted into pixels with subpixel arrangement of P1 and P2 as shown in FIG. 6.

If colors of pixels 1 and 2 of 4CF are represented by replacing them with the subpixel arrangement of P1 and P2, respectively, since G1 or G2 is omitted in P1 and P2, the colors cannot be achieved unless G1/G2 of the adjacent pixel is used. That is, in the pixel 1, white cannot be achieved without turning on G2 of the pixel 2 while white cannot be achieved without turning on G1 of the pixel 1 in the pixel 2. Thus, the resolution is lost when one pixel is displayed using two pixels. Especially, when G1 and G2 which are highly recognizable are both lit, the resolution decreases to approximately a half. Thus, in the present embodiment, white is achieved by a single pixel and is achieved by two pixels when it is tinged green.

Figure 7:
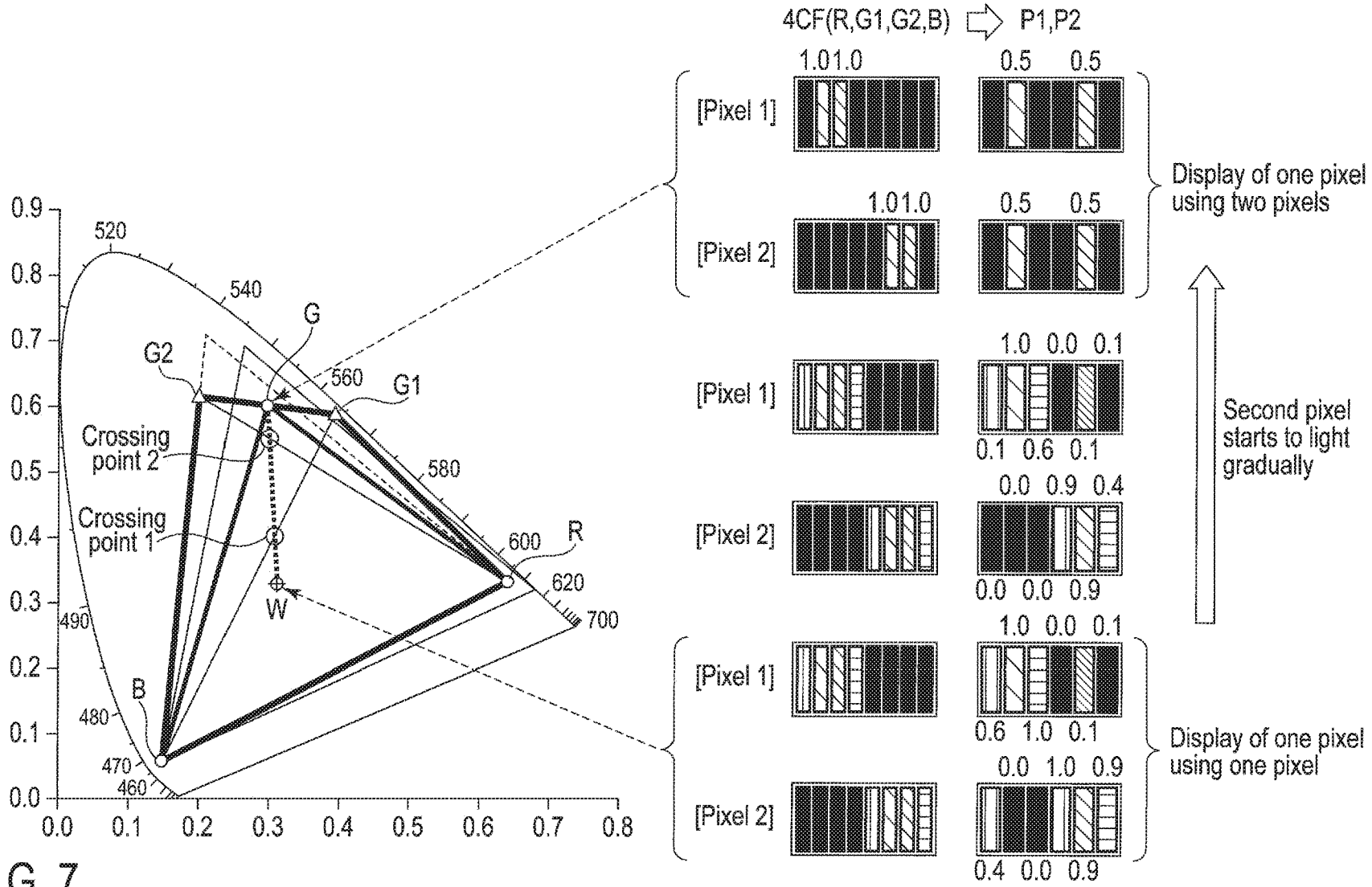
FIG. 7 shows, in the SPR process of the embodiment, a ratio of subpixel brightness of P1 and P2 when the pixels 1 and 2 each show a white point W, crossing point 1, crossing point 2, and reference green point G in 4CF.

FIG. 7 shows a ratio of brightness of subpixels of P1 and P2 when the pixels 1 and 2 each show a white point W, crossing point 1, crossing point 2, and reference green point Gin 4CF. How to determine the ratio will be described later.

Figure 8A:
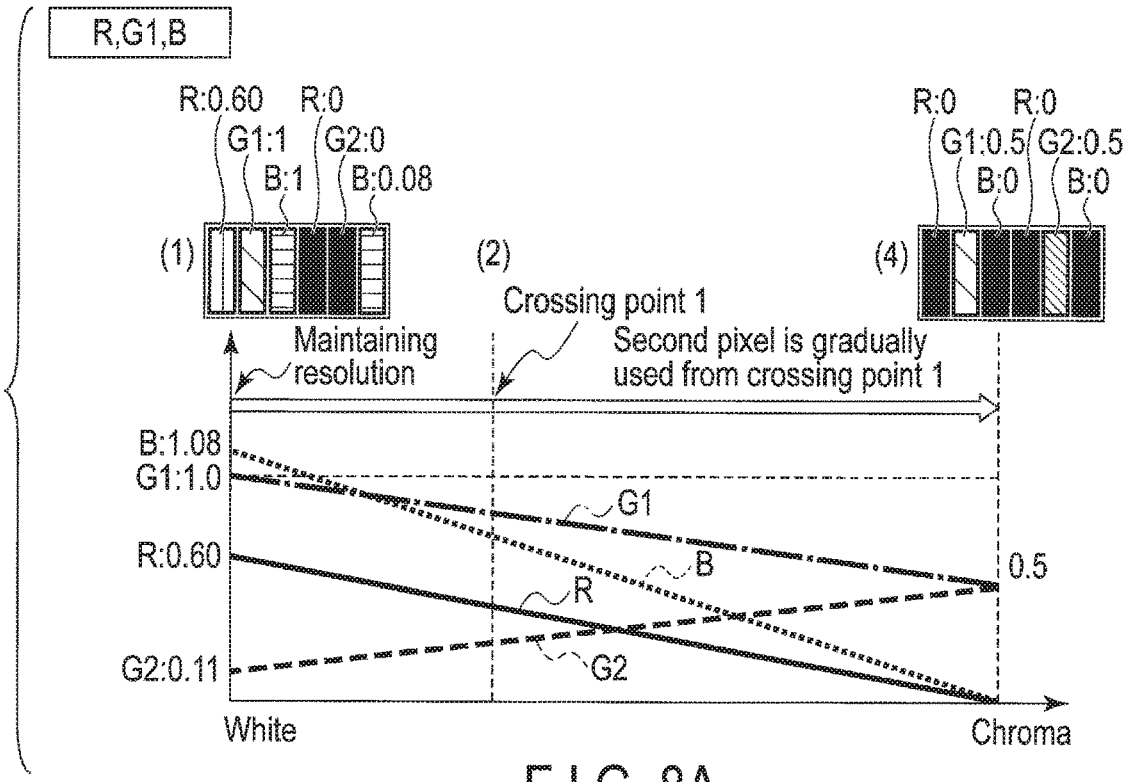
FIGS. 8A and 8B show, in the SPR process of the embodiment, a change in a ratio of R, G1, and B of pixel 1 (P1) and G2 of adjacent pixel 2 (P2) and a change in a ratio of R, G2, and B of pixel 1 (P2) and G1 of adjacent pixel 2 (P1) to maintain the resolution.
Figure 8B:
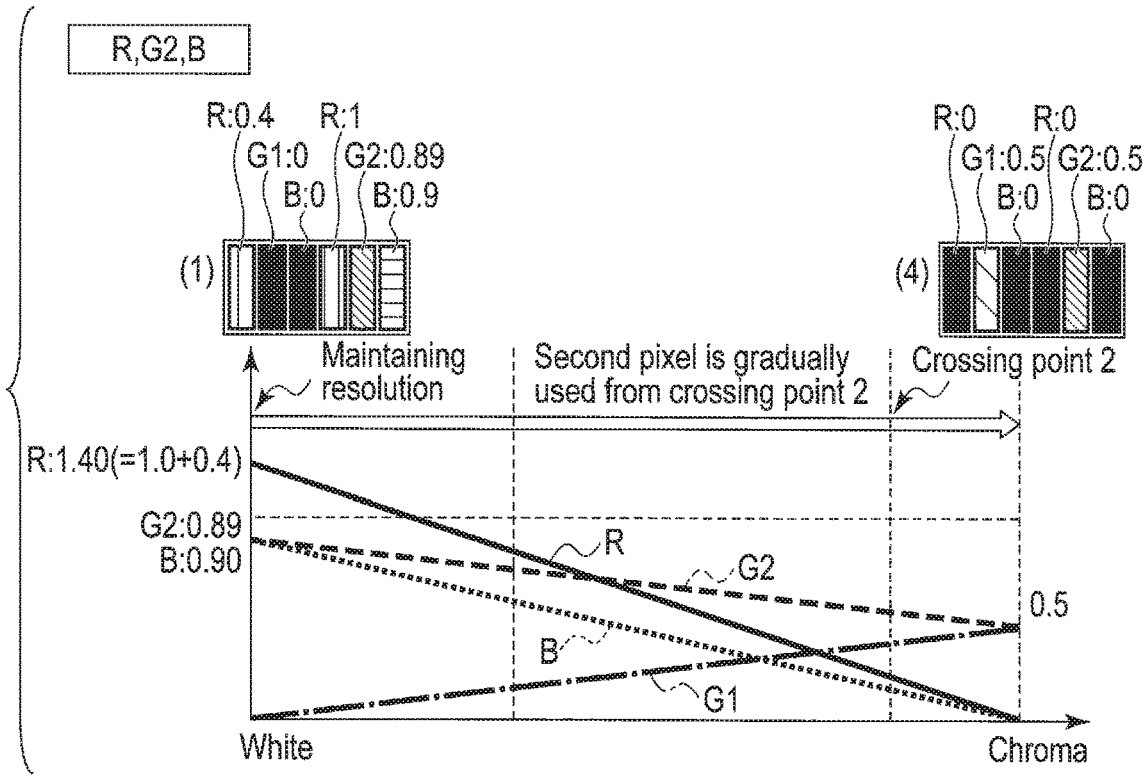

As can be understood from FIG. 7, at white point W, display of one pixel is achievable by one pixel; however, display of one pixel is achieved by two pixels when the color reaches green point G with the second pixel gradually lit from white to green. At that time, a change of ratio between subpixels R, G1, and B of pixel 1 (P1) and subpixel G2 of pixel 2 (P2) adjacent thereto becomes as in an example of FIG. 8A, and G2 of pixel 2 is gradually used. Furthermore, a change of ratio between subpixels R, G2, and B of pixel 1 (P2) and subpixel G1 of pixel 2 (P1) adjacent thereto becomes as in an example of FIG. 8B, and G1 of pixel 2 is gradually used. Note that R requires the brightness of 1.4, and in that case, the brightness of 0.4 is borrowed from R of the adjacent pixel. The adjacent pixel to give the brightness may be one of the upper, lower, right, and left pixels.

In the present embodiment, the color is achieved by one pixel to the crossing point 1 or the crossing point 2 to further increase the resolution, and the second pixel is used after the crossing point 1 or the crossing point 2. At that time, a change of ratio between subpixels R, G1, and B of pixel 1 (P1) and subpixel G2 of pixel 2 (P2) adjacent thereto becomes as in an example of FIG. 9A, and the brightness of G1 and G2 is maintained to the crossing point 1 and the use of subpixel G2 of pixel 2 is gradually increased from the crossing point 1. Furthermore, a change of ratio between subpixels R, G2, and B of pixel 1 (P2) and subpixel G1 of pixel 2 (P1) adjacent thereto becomes as in an example of FIG. 9B, and the brightness of G1 and G2 is maintained to the crossing point 2 and the use of subpixel G1 of pixel 2 is gradually increased from the crossing point 2.

Figure 9A:
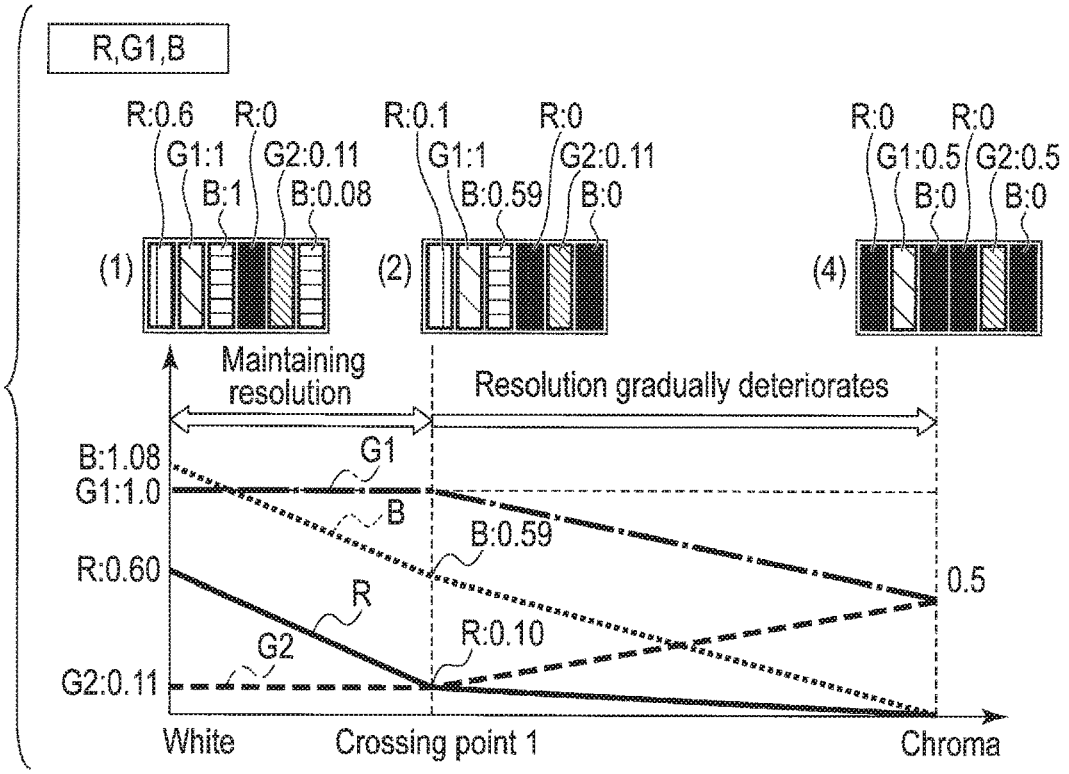
FIGS. 9A and 9B show, in the SPR process of the embodiment, a change in a ratio of R, G1, and B of pixel 1 (P1) and G2 of adjacent pixel 2 (P2) and a change in a ratio of R, G2, and B of pixel 1 (P2) and G1 of adjacent pixel 2 (P1) to further increase the resolution.
Figure 9B:
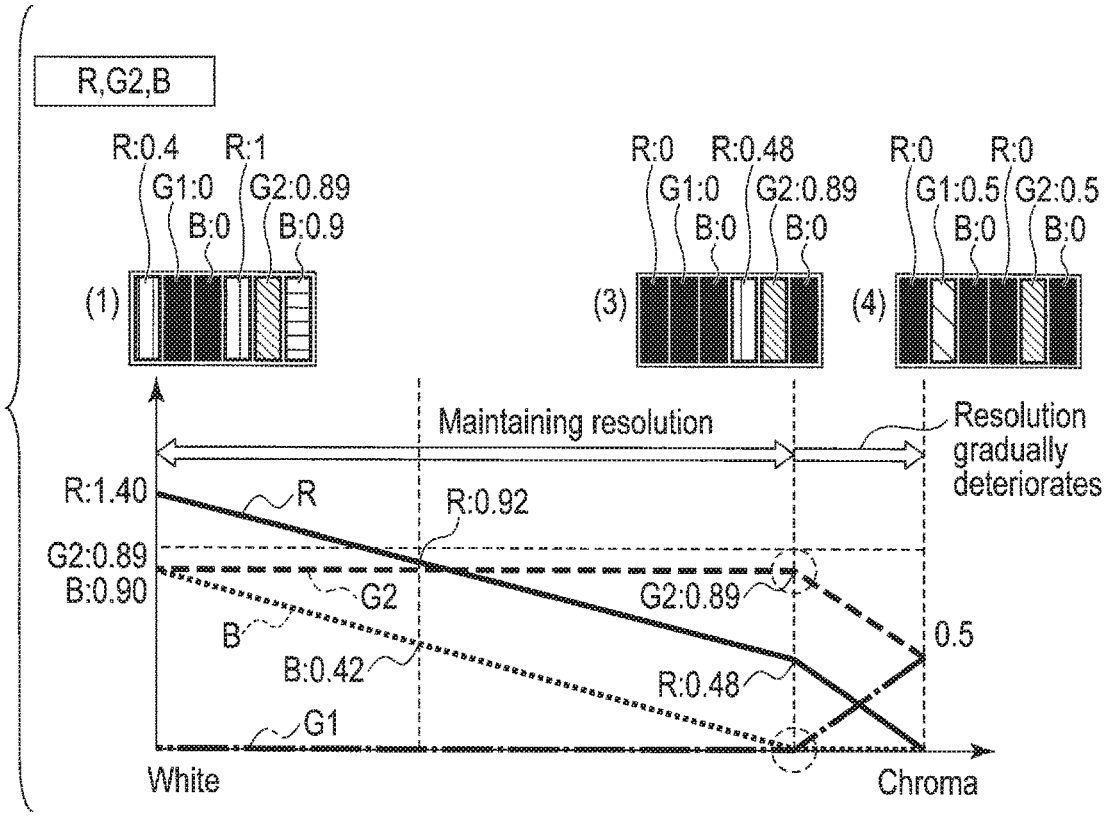

Note that, in FIGS. 9A and 9B, the crossing points 1 and 2 are shown as inflection points of G1 and G2; however, the crossing points may be gradually changed without causing inflection points.

An algorithm to achieve the color change above will be explained.

Figure 10A:
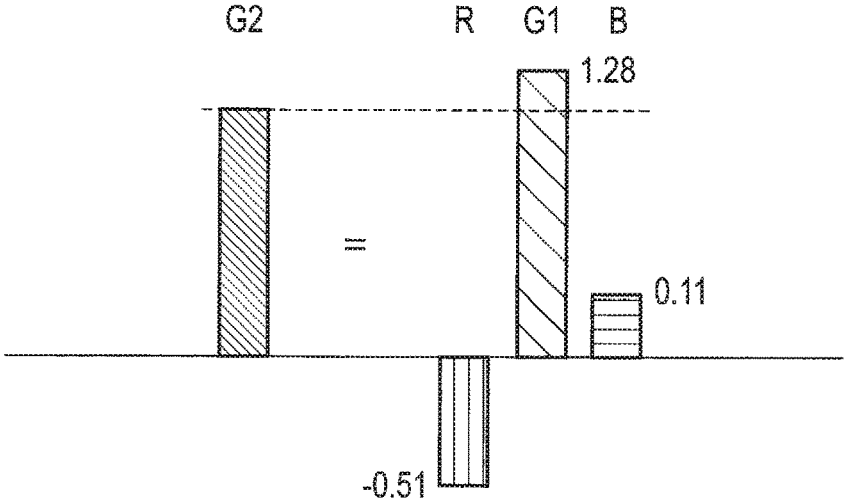
FIGS. 10A and 10B show a brightness ratio and a gamut distribution when the color of G2 is represented by R, G1, and B in the embodiment.
Figure 10B:
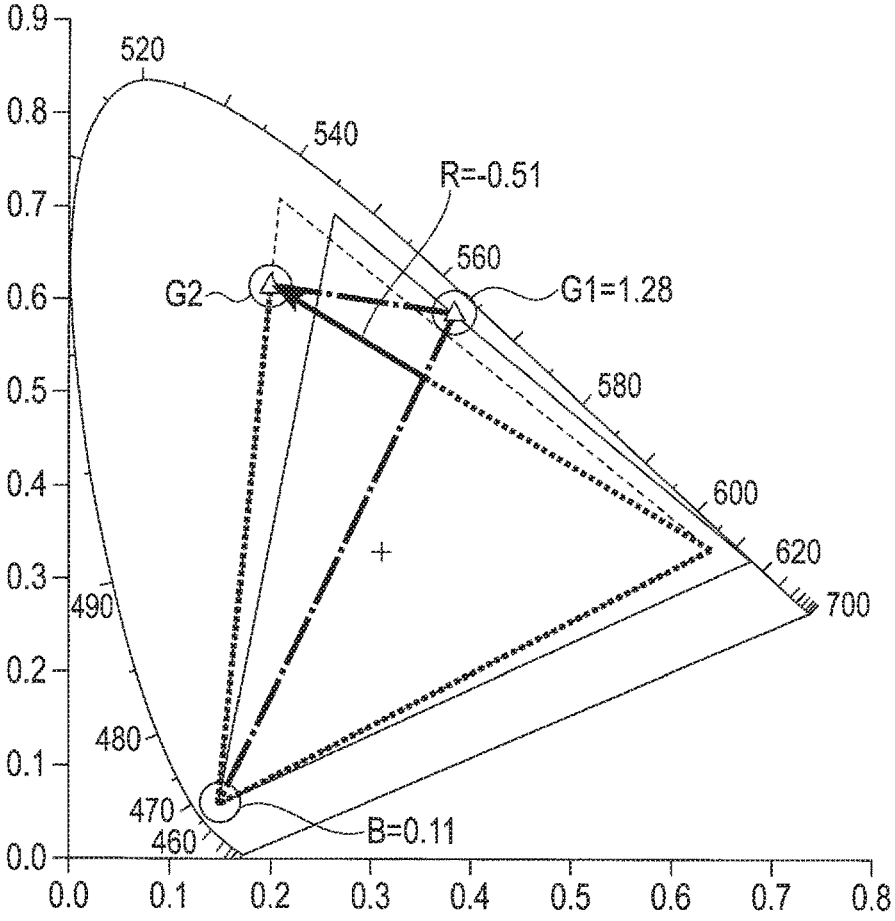

FIG. 10 shows a ratio of brightness and a gamut distribution when a color of G2 is achieved by R, G1, and B. In that case, the following formula is used to achieve the same color as G2.

$$G2=-0.51*R+1.28*G2+0.11*B \quad (1)$$

Figure 11A:
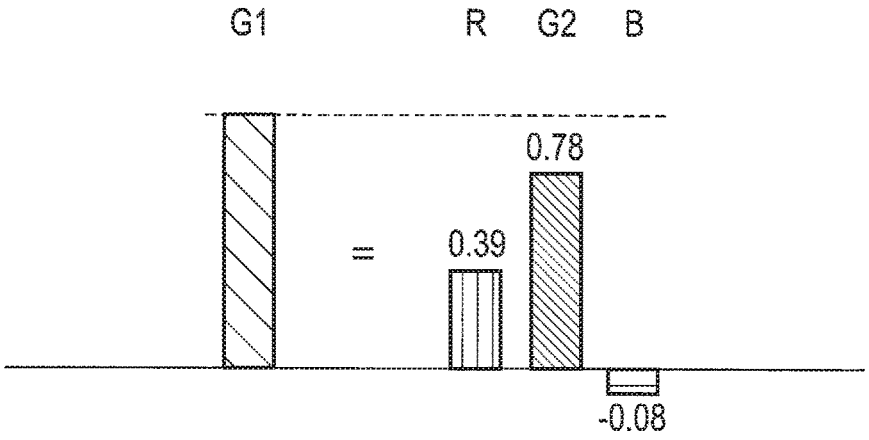
FIGS. 11A and 11B show a brightness ratio and a gamut distribution when the color of G1 is represented by R, G2, and B in the embodiment.
Figure 11B:
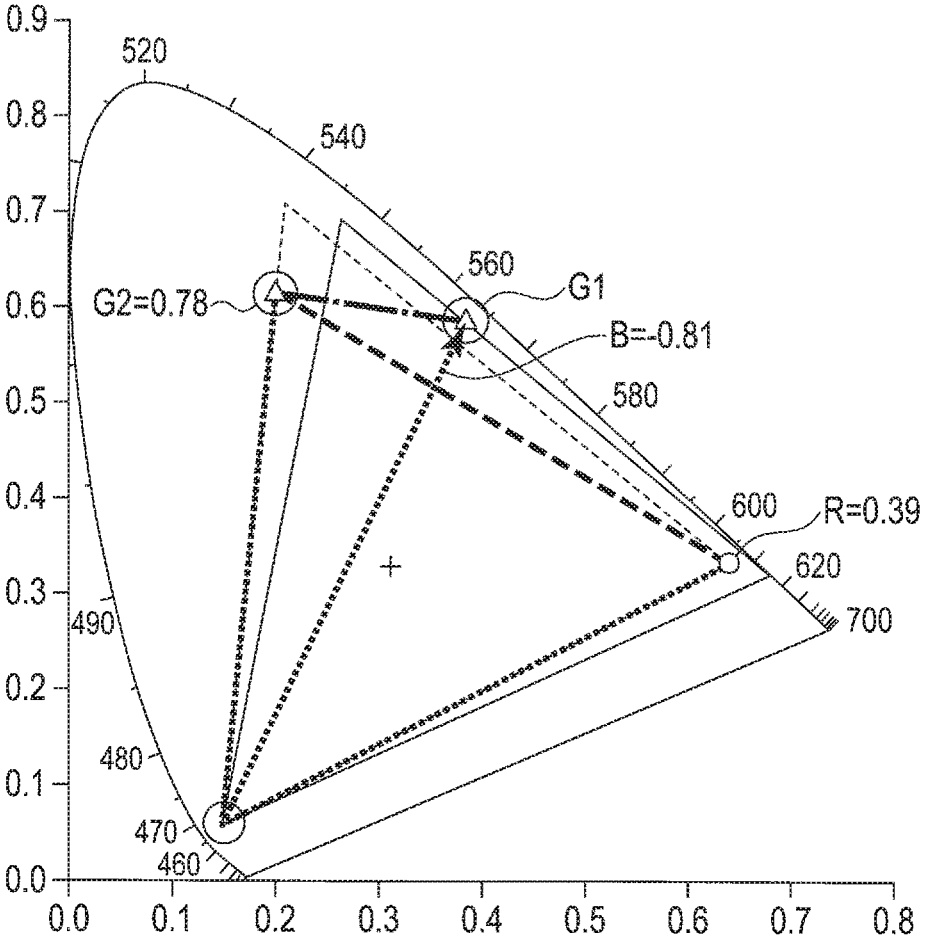

FIG. 11 shows a ratio of brightness and a gamut distribution when a color of G1 is achieved by R, G2, and B. In that case, the following formula is used to achieve the same color as G1.

$$G1=0.39*R+0.78*G2-0.08*B \quad (2)$$

Figure 12A:
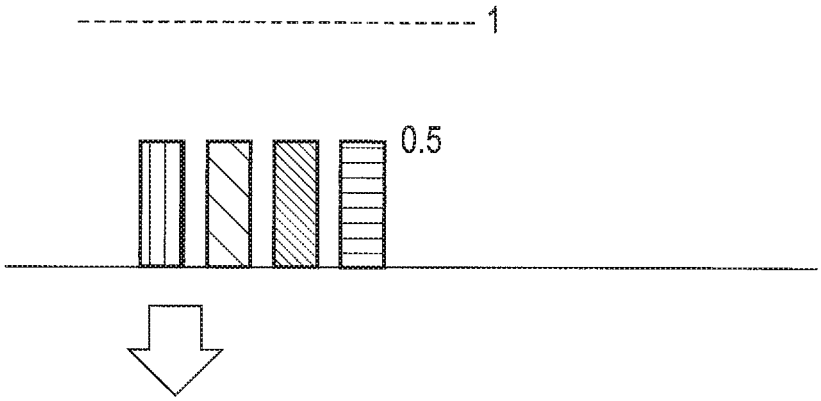
FIGS. 12A to 12D show forming a pixel of P1 from 4CF/2 output representing white in the embodiment.
Figure 12B:
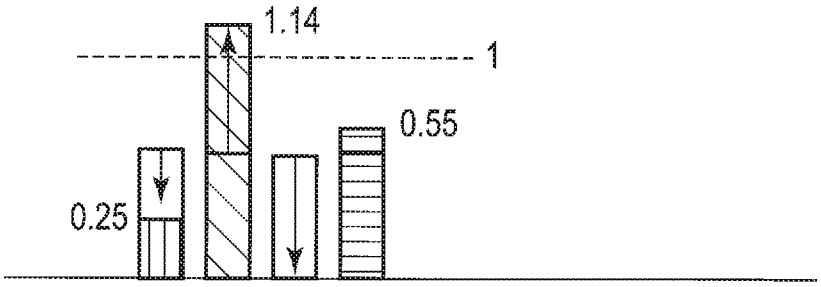

Now, if 4CF/2 output representing white is, as shown in FIG. 12A, R=0.5, G1=0.5, G2=0.5, and B=0.5, the subtraction of 0.5 from G2 will be compensated in R, G1, and B in order for the representation by P1 with G2=0. That is, as shown in FIG. 12B, the formula (1) derives the following.

$$R=0.5-0.51*0.5=0.25$$

$$G1=0.5+1.28*0.5=1.14$$

$$G2=0.5-0.5=0$$

$$B=0.5+0.11*0.5=0.55$$

Figure 12C:
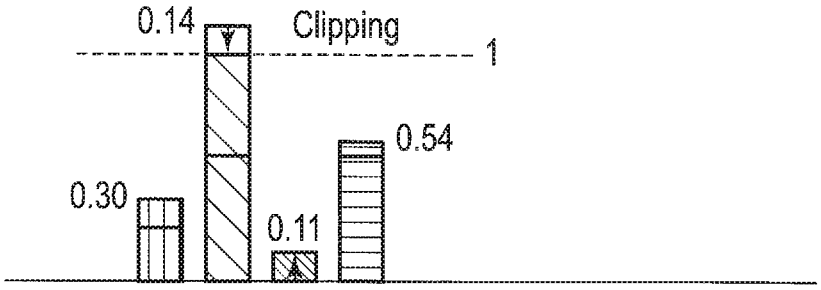
Figure 12D:
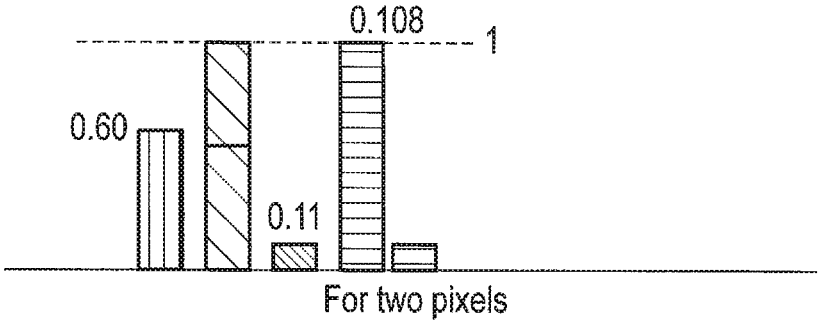

At that time, since G1 is above 1, a clipping process is performed to decrease G1 to 1 and the corresponding brightness is added to R, G2, and B as shown in FIG. 12C.

$$R=0.25+0.39*0.14=0.30$$

$$G1=1.14-0.14=1$$

$$G2=0+0.78*0.14=0.11$$

$$B=0.55-0.08*0.14=0.54$$

Here, R and B are two pixels and each are ½ darker, and thus, the signal level is doubled. At that time, since B is above 1, a clipping process is performed to decrease B to 1 and the residing 0.08 is distributed to the adjacent pixels.

$$R=0.3*2=0.6$$

$$G1=1$$

$$G2=0.11$$

$$B=0.54*2=1.08$$

Figure 13A:
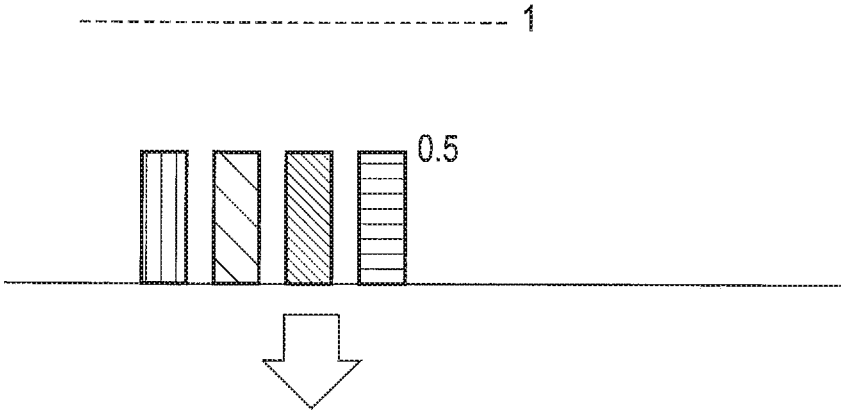
FIGS. 13A to 13C show forming a pixel of P2 from 4CF/2 output representing white in the embodiment.
Figure 13B:
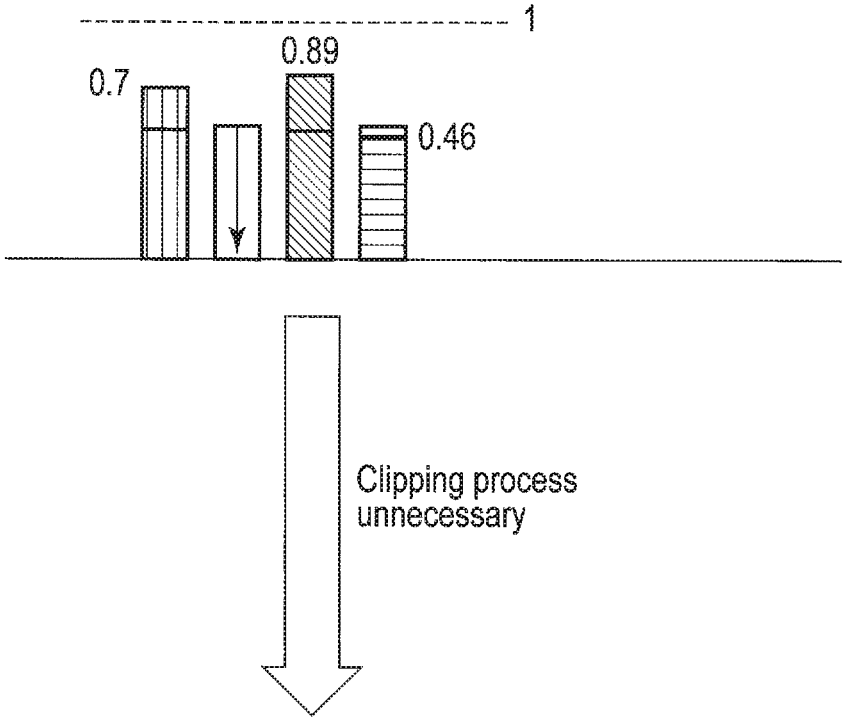

Now, if 4CF/2 output representing white is, as shown in FIG. 13A, R=0.5, G1=0.5, G2=0.5, and B=0.5, the subtraction of 0.5 from G1 will be compensated in R, G2, and B in order for representation by P2 with G1=0. That is, as shown in FIG. 13B, the formula (2) derives the following.

$$R=0.5+0.39*0.5=0.7$$

$$G1=0.5-0.5=0$$

$$G2=0.5+0.78*0.5=0.89$$

$$B=0.5-0.08*0.5=0.46$$

Figure 13C:
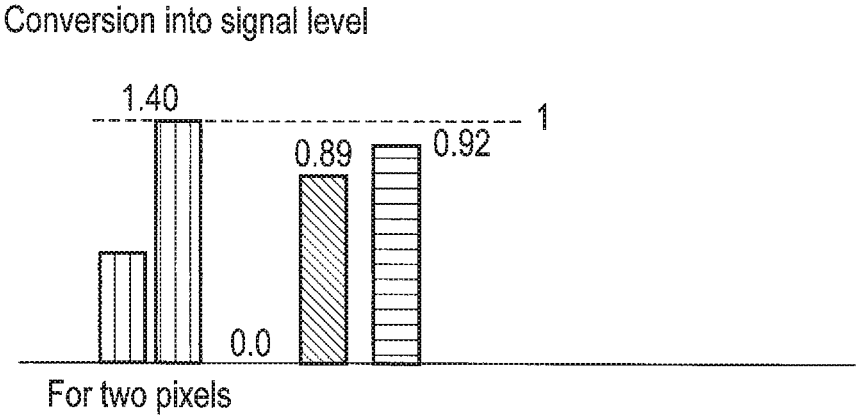

At that time, no color is above 1, and a clipping process is not required. Here, R and B are two pixels and each are ½ darker, and thus, the signal level is doubled. At that time, since R is above 1, a clipping process is performed to decrease R to 1, and the residue is distributed to the adjacent pixels as shown in FIG. 13C.

$$R=0.7*2=1.40$$

$$G1=0$$

$$G2=0.89$$

$$B=0.46*2=0.92$$

Figure 14A:
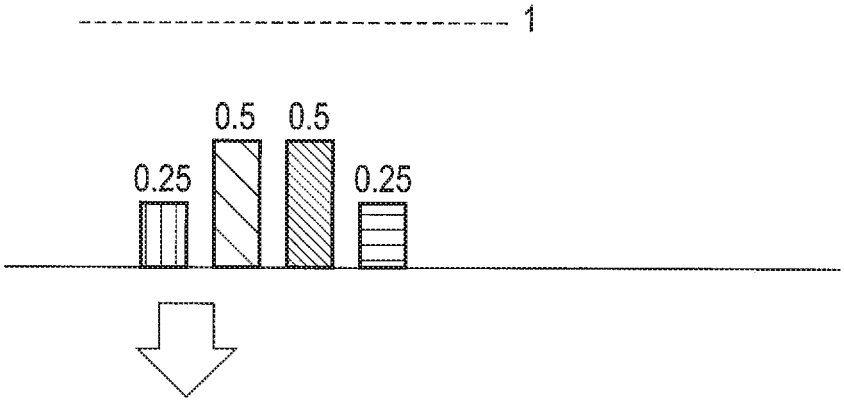
FIGS. 14A to 14D show forming a pixel of P1 from 4CF/2 output representing crossing point 1 in the embodiment.
Figure 14B:
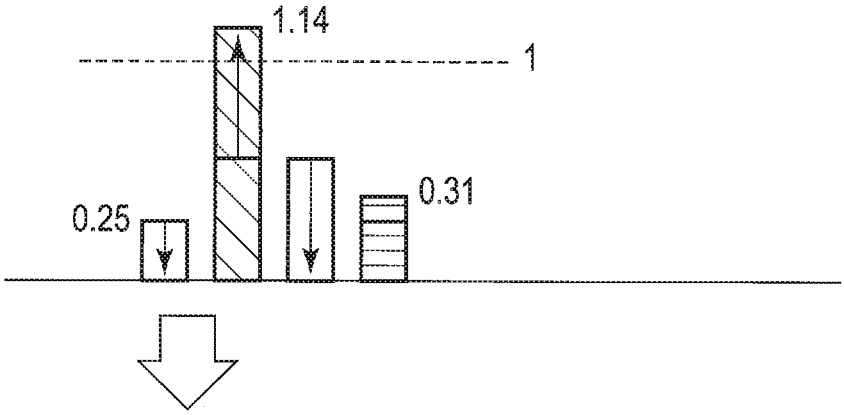

Then, at the crossing point 1, if 4CF/2 output is, as shown in FIG. 14A, R=0.25, G1=0.5, G2=0.5, and B=0.25, the subtraction of 0.5 from G2 will be compensated in R, G1, and B in order for representation by P1 with G2=0. That is, as shown in FIG. 14B, the formula (1) will derive the following.

$$R=0.25-0.51*0.5=0$$

$$G1=0.5+1.28*0.5=1.14$$

$$G2=0.5-0.5=0$$

$$B=0.25+0.11*0.5=0.31$$

Figure 14C:
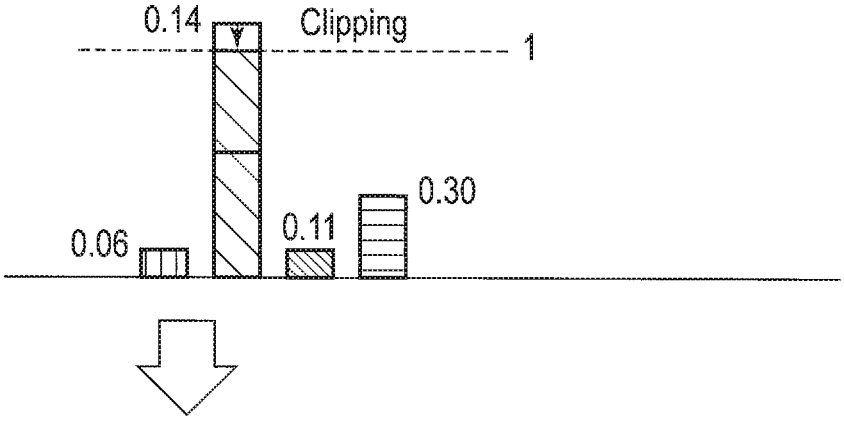

At that time, since G1 is above 1, a clipping process is performed to decrease G1 to 1 and the corresponding brightness is added to R, G2, and B as shown in FIG. 14C.

$$R=0+0.39*0.14=0.06$$

$$G1=1.14-0.14=1$$

$$G2=0+0.78*0.14=0.11$$

$$B=0.31-0.08*0.14=0.30$$

Figure 14D:
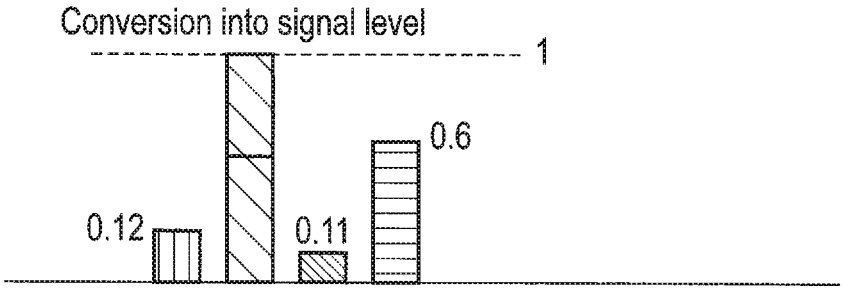

Here, R and B are two pixels and each are ½ darker, and thus, the signal level is doubled as shown in FIG. 14D.

$$R=0.6*2=0.12$$

$$G1=1$$

$$G2=0.11$$

$$B=0.30*2=0.6$$

Figure 15A:
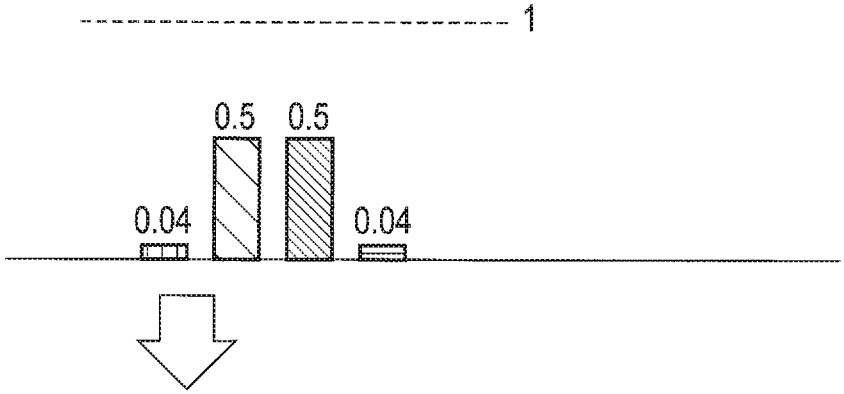
FIGS. 15A to 15C show forming a pixel of P2 from 4CF/2 output representing crossing point 2 in the embodiment.
Figure 15B:
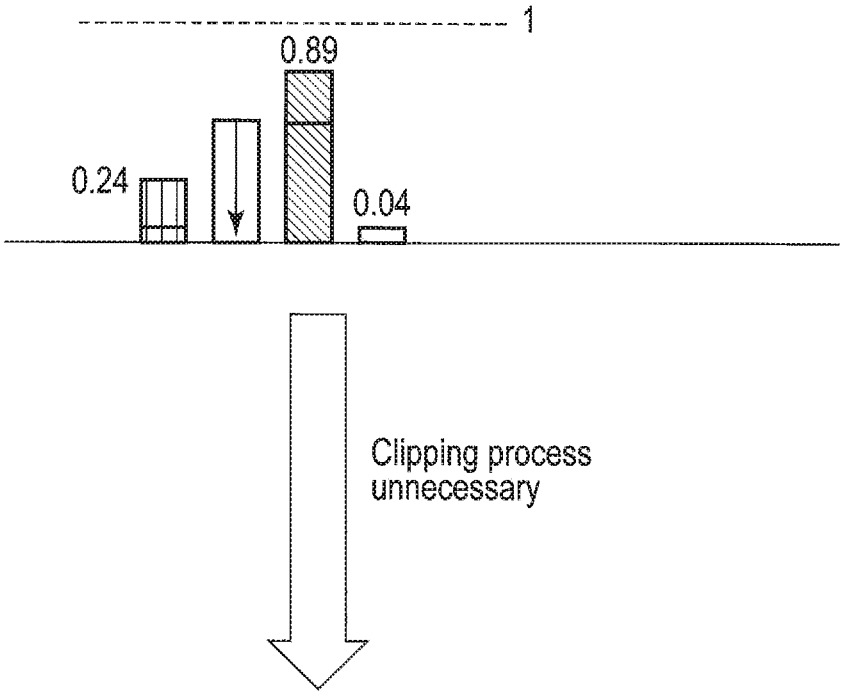

Then, at the crossing point 2, if 4CF/2 output is, as shown in FIG. 15A, R=0.04, G1=0.5, G2=0.5, and B=0.04, the subtraction of 0.5 from G1 will be compensated in R, G2, and B in order for representation by P2 with G1=0. That is, as shown in FIG. 15B, the formula (2) will derive the following.

$$R=0.04+0.39*0.5=0.24$$

$$G1=0.5-0.5=0$$

$$G2=0.5+0.78*0.5=0.89$$

$$B=0.04-0.08*0.5=0$$

Figure 15C:
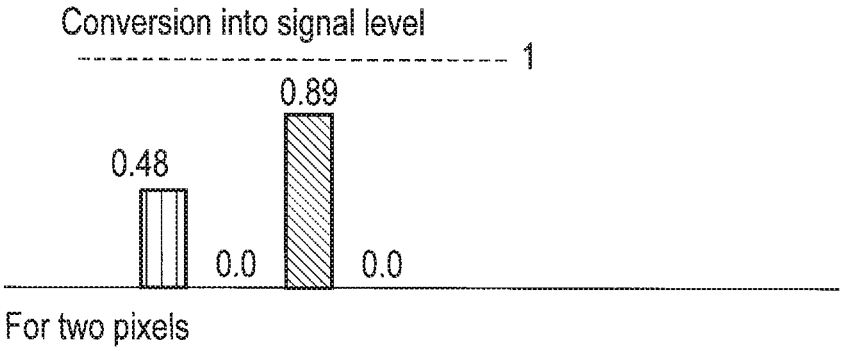

At that time, no color is above 1, and a clipping process is not required. Here, R and B are two pixels and each are ½ darker, and thus, the signal level is doubled as shown in FIG. 15C.

$$R=0.24*2=0.48$$

$$G1=0$$

$$G2=0.89$$

$$B=0*2=0$$

Figure 16A:
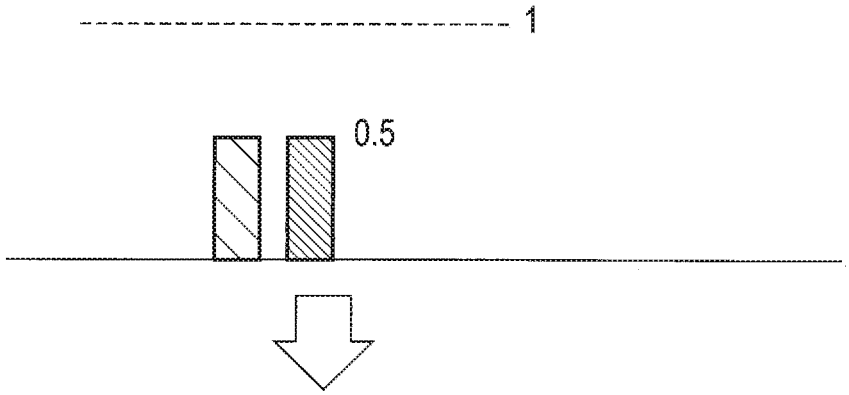
FIGS. 16A to 16D show forming a pixel of P1 from 4CF/2 output representing green in the embodiment.
Figure 16B:
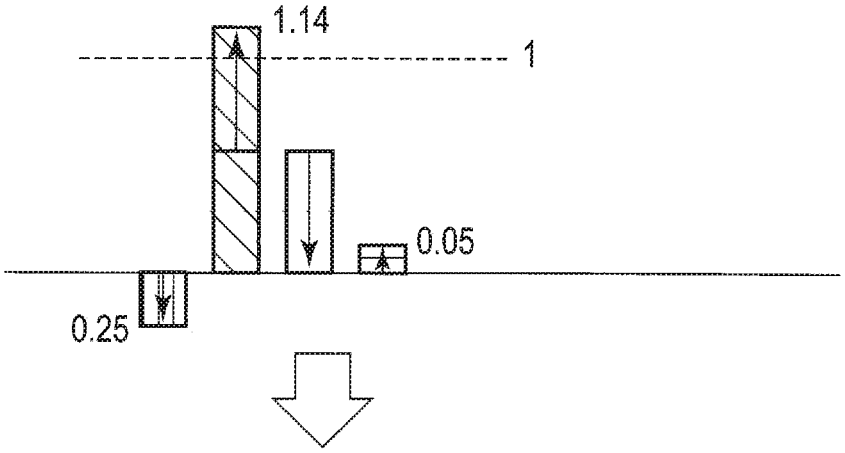

Then, if 4CF/2 output representing green is, as shown in FIG. 16A, R=0, G1=0.5, G2=0.5, and B=0, the subtraction of 0.5 from G2 will be compensated in R, G1, and B in order for representation by P1 with G2=0. That is, as shown in FIG. 15B, the formula (1) will derive the following.

$$R=0-0.51*0.5=-0.25$$

$$G1=0.5+1.28*0.5=1.14$$

$$G2=0.5-0.5=0$$

$$B=0+0.11*0.5=0.05$$

Figure 16C:
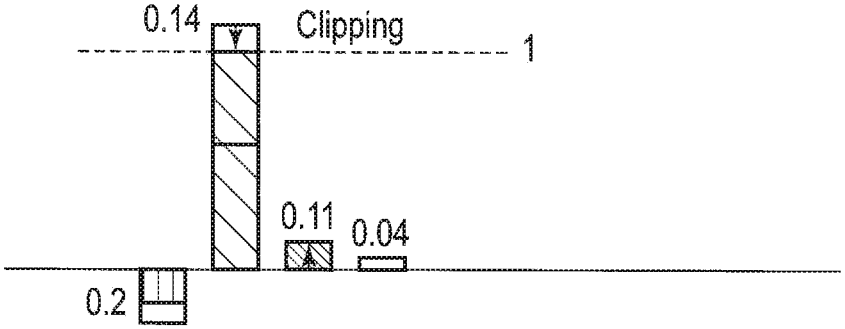

At that time, since G1 is above 1, a clipping process is performed to decrease G1 to 1 and the corresponding brightness is added to R, G2, and B as shown in FIG. 16C.

$$R=-0.25+0.39*0.14=0.20$$

$$G1=1.14-0.14=1$$

$$G2=0+0.78*0.14=0.11$$

$$B=0.05-0.08*0.14=0.04$$

Here, R is represented as follows by transforming the formula (2).

$$R=2.53*G1-1.98*G2+0.21*B \quad (3)$$

Figure 16D:
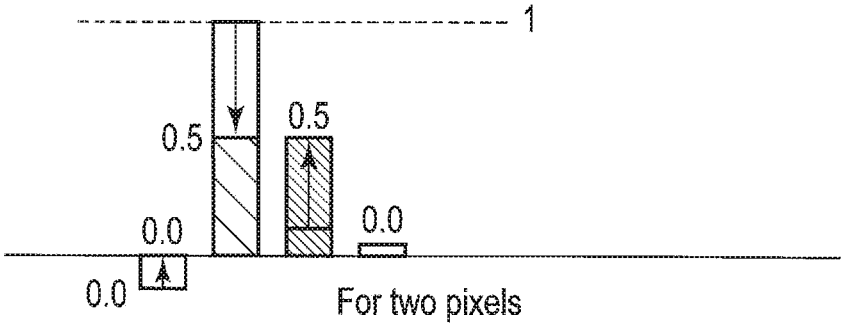

Thus, by the signal level conversion, each subpixel output will be as follows as shown in FIG. 16D.

$$R=-0.2+0.2=0$$

$$G1=1-2.53*0.2=0.5$$

$$G2=0.11+1.98*0.2=0.5$$

$$B=0.04-0.21*0.2=0$$

Figure 17A:
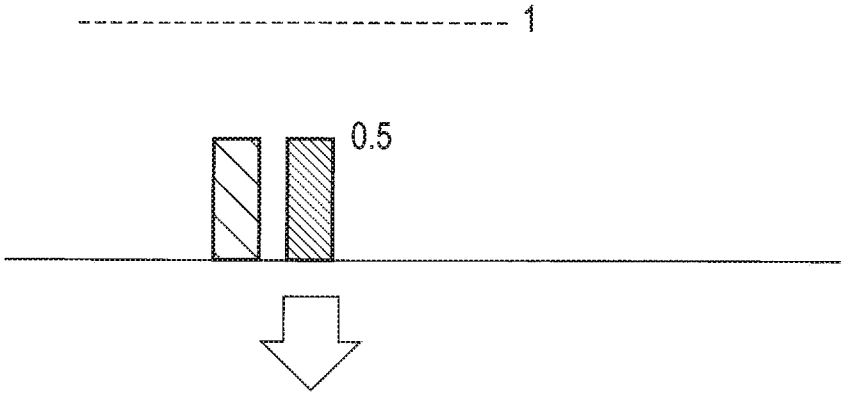
FIGS. 17A to 17C show forming a pixel of P2 from 4CF/2 output representing green in the embodiment.
Figure 17B:
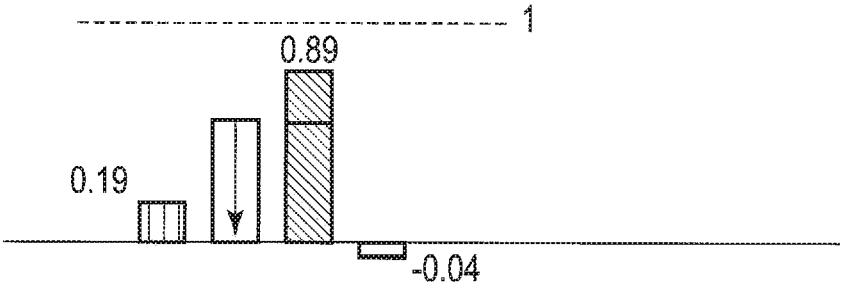

Then, if 4CF/2 output representing white is, as shown in FIG. 17A, R=0, G1=0.5, G2=0.5, and B=0, the subtraction of 0.5 from G1 will be compensated in R, G2, and B in order for representation by P2 with G1=0. That is, as shown in FIG. 17B, the formula (2) will derive the following.

$$R=0+0.39*0.5=0.19$$

$$G1=0.5-0.5=0$$

$$G2=0.5+0.78*0.5=0.89$$

$$B=0-0.08*0.5=-0.04$$

At that time, no color is above 1, and a clipping process is not required. Here, B is represented as follows by transforming the formula (1).

$$B=4.73*R-11.96*G1-9.34*G2 \quad (4)$$

Figure 17C:
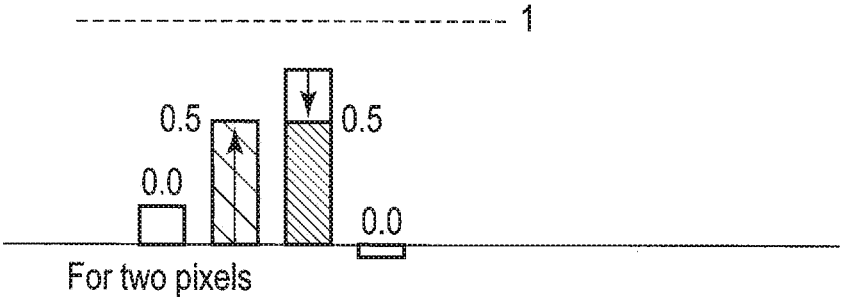

Thus, by the signal level conversion, each subpixel output will be as follows as shown in FIG. 17C.

$$R=0.19-4.73*0.04=0$$

$$G1=11.96*0.04=0.5$$

$$G2=0.89-9.34*0.04=0.5$$

$$B=-0.04+0.04=0$$

With the algorithm explained above, the brightness of subpixels of P1 and P2 are determined, and thus, in the white display of one pixel, turning on of G1 or G2 is prioritized to adjust the color temperature of white with R and B, and the color temperature can be adjusted from the white point W to the crossing point 1 or the crossing point 2 without changing the brightness of G1 and G2. Thus, a single vertical line, horizontal line, and diagonal line of single color can be displayed with a straight line with RGBW, and the resolution can be maintained.

Note that, in the above-described embodiment, the liquid crystal display device is exemplified; however, the embodiment can be applied to a display device using an organic EL panel.

Furthermore, in the above-described embodiment, the referential gamut distribution is HDTV broadcast standard BT.709; however, the embodiment can be applied to other format images such as Adobe RGB, and DCI.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A display device comprising:

a display panel with a first pixel including subpixels of red, first green which is tinged red as compared to a reference green, and blue, and a second pixel including subpixels of red, second green which is tinged blue as compared to the reference green, and blue, where the first pixel and the second pixel are arranged alternately; and a conversion circuit configured to generate a four primary color image of red, first green, second green, and blue from a three primary color image of red, reference green, and blue and to perform rendering a first image and a second image from the four primary color image, wherein the conversion circuit prioritizes turning on of the first green in the first pixel and turning on of the second green in the second pixel and adjusts a color temperature of white with red and blue during white displaying of a pixel.

2. The display device of claim 1, wherein the conversion circuit replaces, in the first pixel, a brightness of the second green with a brightness of red, first green, and blue representing the same color to add the replaced brightness to each subpixel, and replaces, in the second pixel, a brightness of the first green with a brightness of red, second green, and blue representing the same color to add the replaced brightness to each subpixel.

3. The display device of claim 1, wherein the conversion circuit adjusts the color temperature without changing a brightness of the first green in a gamut of the first pixel and adjusts the color temperature without changing a brightness of the second green in a gamut of the second pixel between white and reference green in a gamut of the three primary color image.

4. A display method comprising:

generating, with respect to a display panel with a first pixel including subpixels of red, first green which is tinged red as compared to a reference green, and blue, and a second pixel including subpixels of red, second green which is tinged blue as compared to the reference green, and blue, where the first pixel and the second pixel are arranged alternately, a four primary color image of red, first green, second green, and blue from a three primary color image represented by the red, reference green, and blue;

prioritizing turning on of the first green in the first pixel and turning on of the second green in the second pixel in white displaying of one pixel when rendering from the four primary color image to the first pixel and the second pixel is performed; and adjusting a color temperature of white with red and blue.

5. The display device of claim 4, wherein a brightness of the second green is replaced with a brightness of red, first green, and blue representing the same color to be added to each subpixel in the first pixel, and a brightness of the first green is replaced with a brightness of red, second green, and blue representing the same color to be added to each subpixel in the second pixel.

6. The display device of claim 4, wherein the color temperature is adjusted without changing a brightness of the first green in a gamut of the first pixel and the color temperature is adjusted without changing a brightness of the second green in a gamut of the second pixel between white and reference green in a gamut of the three primary color image.

* * * * *